US007585261B2

(12) United States Patent
Serlachius

(10) Patent No.: US 7,585,261 B2
(45) Date of Patent: Sep. 8, 2009

(54) APPARATUS FOR EXERCISING DEEP ABDOMINAL AND BACK MUSCLES

(76) Inventor: Jarl Fredrik Serlachius, Kavallintie 1 E, 47, Kauniainen (FI) FI-02700

( * ) Notice: Subject to any disclaimer, the term of this patent is extended or adjusted under 35 U.S.C. 154(b) by 61 days.

(21) Appl. No.: 11/569,831

(22) PCT Filed: May 30, 2005

(86) PCT No.: PCT/FI2005/000244

§ 371 (c)(1),
(2), (4) Date: Nov. 30, 2006

(87) PCT Pub. No.: WO2005/115560

PCT Pub. Date: Dec. 8, 2005

(65) Prior Publication Data

US 2008/0125296 A1 May 29, 2008

(30) Foreign Application Priority Data

May 31, 2004 (FI) ..... 20040223 U
Apr. 11, 2005 (FI) ..... 20050363

(51) Int. Cl.
*A63B 21/04* (2006.01)
*A63B 26/00* (2006.01)

(52) U.S. Cl. ..... 482/130; 482/140

(58) Field of Classification Search ..... 482/140, 482/907, 121–130, 43, 143, 904, 33, 92
See application file for complete search history.

(56) References Cited

U.S. PATENT DOCUMENTS

| | | | | |
|---|---|---|---|---|
| 2,760,486 | A * | 8/1956 | Ward | 602/19 |
| 4,113,250 | A * | 9/1978 | Davis | 482/144 |
| 4,372,552 | A * | 2/1983 | Carlmark | 482/143 |
| 5,033,460 | A * | 7/1991 | Goldish | 606/241 |
| 6,312,366 | B1 * | 11/2001 | Prusick | 482/130 |
| 6,485,400 | B1 * | 11/2002 | Serlachius | 482/142 |
| 6,514,182 | B1 * | 2/2003 | Chhloeum | 482/130 |
| 6,905,447 | B1 * | 6/2005 | Walter | 482/121 |
| 2003/0139267 | A1 * | 7/2003 | Janora | 482/140 |

* cited by examiner

*Primary Examiner*—Loan H Thanh
*Assistant Examiner*—Allana Lewin
(74) *Attorney, Agent, or Firm*—Brooks Kushman P.C.

(57) ABSTRACT

The invention is an apparatus for exercising deep abdominal and back muscles, consisting of a minimum of at least two flexible vertical frames at a distance from each other for a person to fit in, whose other ends are anchored onto a base. The frames are connected to one another with an up/down adjustable abdominal/back support.

2 Claims, 5 Drawing Sheets

APPARATUS FOR EXERCISING DEEP ABDOMINAL AND BACK MUSCLES

BACKGROUND OF THE INVENTION

1. Field of the Invention

The invention relates to an apparatus for resiliently resisting standing body-bending motions to exercise deep abdominal and back muscles.

2. Background Art

In recent years, apparatuses for training muscles have increasingly entered the market. A few decades back, everything started from an ordinary barbell, which also presently continues to be a very popular general exercise apparatus. Today, there are versatile multifunctional apparatuses with solutions for exercising nearly all individual muscles separately in the market. In addition, there are apparatuses for exercising a certain muscle or group of muscles. The multitude of equipment on offer today is a jungle of brand manufactures fighting for clients with various means. At times the quality, and at times the price, is the factor, which triggers the reaction to buy. Earlier, there were mostly inexpensive exercise apparatuses in the market; today, gyms with their expensive exercise equipment parks dominate the field. In these days, people are not supposed to sweat at home. As regularly as they were earlier doing barbell exercises at home or in their basement, now, instead, they go to professionally run gym exercise sessions, where, as needed, they change from one expensive exercise apparatus to another. And, when they come back home, they devote their time to lighter hobbies, such as their computer.

Regardless, at an accelerating rate today, man's biggest physical problems continue to include back problems, especially in the lumbar region. One explanation for this is irregular exercising. It is true that, today, people take care of their physical fitness, but, in reality, very few individuals exercise regularly. The threshold to exercise daily is too high, if the gym is the venue for physical stress. There simply is not enough time. For improving a person's physical fitness, a minimum of 30 minutes of regular exercise each day is needed. But, it is surprising that only 3 to 5 minutes of daily back exercises are needed for the back. Why, then, so many backs are in bad shape, if the solution is to be found in a few minutes of daily exercises. There simply is no easy-to-use apparatus for a person inclined to enjoy comfort to bother with. A person can do proper exercises without any equipment, but, to start doing such exercises may seem both boring and difficult. First you lie on your back and repeatedly raise your feet and hands simultaneously about 15 cm from the floor for 2 minutes; and then you repeat this lying on your stomach. This exercise would be a solution for keeping a person's back in good shape, but, for various reasons, many people find lying on the floor unpleasant and difficult. One reason is that it might be physically impossible for a person to get into a lying position on the floor if, for instance, he/she has a big stomach or his/her legs are hurting. For the same reasons, people do not use folding benches for exercising abdominal and back muscles at home. And, the barbell is not suitable a suitable means of physical therapy for the back. Taking into consideration that research has proved that abdominal and back exercises done standing up are the most natural way in respect to the physiology of man's back, it can be stated that there are not many home exercise apparatuses designed which employ methodology. Among the most usual home exercise equipment are the barbell, the bullworker, a spring with handles, an arched board, a bench for exercising abdominal and back muscles, a rowing exercise apparatus, an exercise bike, a stepper, and rather big equipment for exercising the entire body. Among these, the arched board and the Ab Bench are the only ones directed at exercising abdominal and back muscles. These exercises are done lying down, which has been shown not to be as effective as exercises done standing up. We are talking here about the deep abdominal and back muscles, which, according to studies done in recent years, are the muscles supporting the dorsal disk, and, consequently, keeping the back healthy. To keep these muscles in shape, the best exercise position is the standing position, in which the strain on the back is evenly distributed and it is safe to do the exercise movements also when a person's back is hurting. The standing position is also the position, which is most favorable, for instance, in case of an overweight body. It is difficult for a heavy person to crawl to lie down in a horizontal position and do the exercises and then stand back up from the floor. The Finnish invention, FI 940623, is an apparatus for exercising deep abdominal and back muscles in a standing position. Its structure is heavy and it is expensive and actually designed for gym and corporate use. The apparatus consists of one long flexible frame, which has three body support points attached to it, which allow the frame to be bent with the help of the body. The frame is in a way attached to the body in three places, generating a counterforce when bending the body from the waist either forward or backward, depending on whether the exercises are directed at the abdominal or back muscles. Consequently, as it feels rather heavy and has a multitude of adjustment mechanisms, the apparatus is impractical. As it does not stand on its own support base or have a backing, as the operator's legs are tied at the ankles to the lowest cross support, this may create a danger to the body when trying to keep it in balance. In the event the person falls down, it is practically impossible to detach him/herself from the cross support, and the consequences may be rather disastrous. For safety reasons, the exercises have to be performed using a wall as the background support in case of falling down. This is very cumbersome. The frame is another disadvantage as it is uncomfortably close to the face. In order for it not to hurt the face, the surface of the upper support facing the person has to be at a distance from the actual frame. The solution used for this is a collar-like harness on the shoulders. The harness has to be always adjusted to the operator's length and chest size. Hence, the apparatus has the means for length, depth, and width adjustment. As the point where the harness is attached to the body is far from the frame, the middle support has to also project from the frame. As for the bottom leg support, the person doing the exercises has to know how to adjust it correctly so that it supports the ankles. The apparatus is intended for easy back exercises, which can also be done in any situation. It has been proven that regular, circa 3 minutes of daily exercise is enough to keep a person's back in good shape. The apparatus does not make the operator sweat or wrinkle his/her clothing; hence, daily exercises may be performed just before leaving for a party, e.g., wearing a suit and a tie. So, this is possible with an exercise apparatus where the exercises are done standing up. The operator only turns a half a circle in the apparatus when changing to exercise another muscle group, i.e., from abdominal muscle exercises to back muscle exercises. Research has shown that very small movements against a counterforce are used for exercising deep abdominal and back muscles. Based on the above, the Finnish apparatus for exercising back muscles should have the preconditions for becoming popular among people with busy lifestyle. But, it has also been explained above why this has not happened. The apparatus is too complicated and, for this reason, undeniably too expensive for a mass product. Technophysiologically, the apparatus does meet the criteria for an optimally operating apparatus for exercising deep abdominal and back muscles, but, as stated many times, the apparatus's own technical solution is too complex and expensive for the apparatus to become people's daily means of exercise. One of the factors contributing to the expensive solution that can be mentioned is the requirement that both the upper support and middle support have to be at a certain distance from the frame. This has resulted in the expensive solutions in regard to the frame attachments. As the supports have to be always adjusted to the operator's measurements, this is so tedious that the threshold for instinctive use of the apparatus is too high.

How to produce a solution that is technically inexpensive and simple enough, which would still meet the technophysiological prerequisites for optimally effective exercising of abdominal and back muscles remains a problem.

BRIEF SUMMARY OF THE INVENTION

The present invention overcomes the abovementioned problem by providing an apparatus for exercising deep abdominal and back muscles while in a standing position. The apparatus includes a base and at least a first and a second vertical frame member anchored to the base. Each vertical frame member has at least a flexible upper portion, and the vertical frame members are spaced apart and extend parallelly upwardly from the base. A vertically adjustable middle support extends transversely between, and is proximately connected to midpoints of, the vertical frame members. The base includes an independent plate upon which a person stands while exercising, and padding is affixed to the upper portion of each vertical frame member.

BRIEF DESCRIPTION OF THE DRAWINGS

The following is an explanation of the apparatus, with references to the drawings, in which.

DETAILED DESCRIPTION OF THE PREFERRED EMBODIMENT

Figure 1:
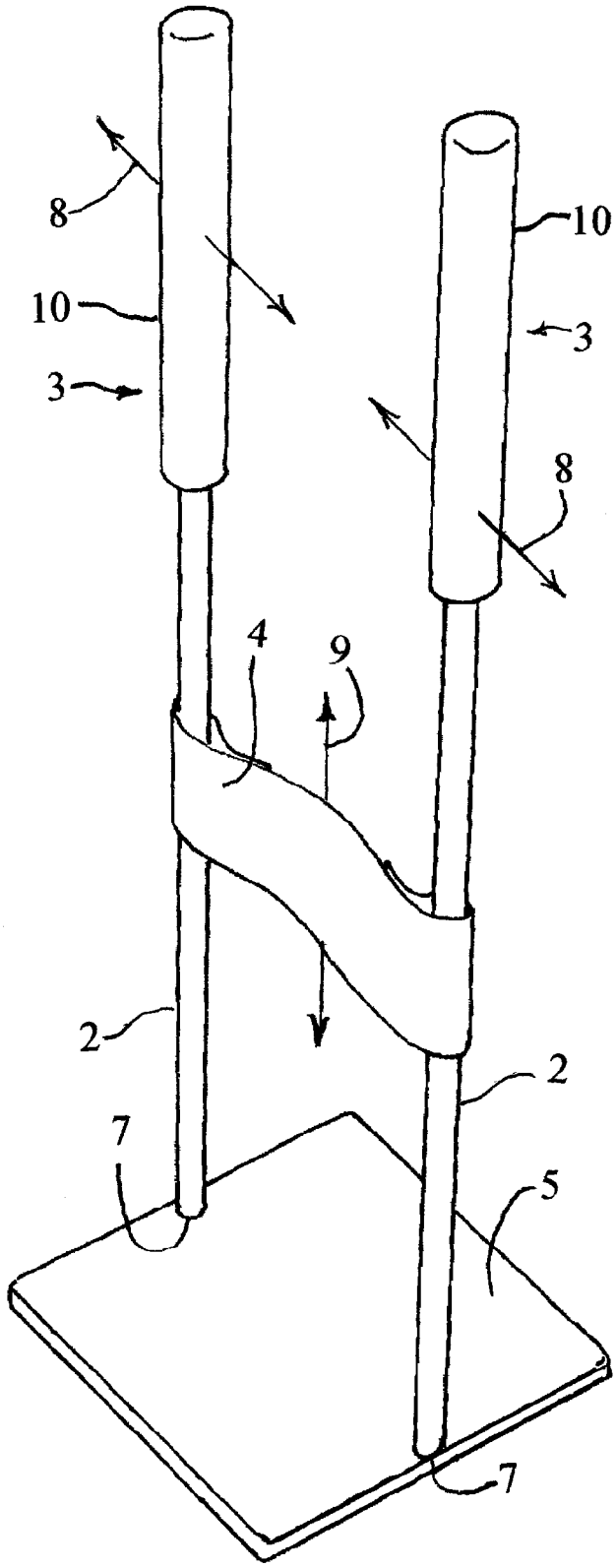
FIG. 1 is a perspective view of the apparatus in accordance with the present invention.

FIG. 1 is a perspective view of the apparatus, which has at least first and second vertical frame members 2. Each of the two vertical frame members 2 has at least an upper portion, generally indicated by the reference numeral 3, that is flexible. A vertically adjustable middle support 4 extends transversely between, and is proximately connected to midpoints of, the vertical frame members 2. The middle support 4 can be raised and lowered as required, as indicated by arrows 9. Lower ends 7 of the vertical frame members 2 are anchored to a base 5, are spaced apart, and extend parallelly upwardly from the base 5. As indicated by arrows 8, the upper portions 3 of the vertical frame members 2 can be laterally positioned as required to accommodate persons of various sizes and to facilitate his or her movements between the vertical frame members. Padding 10 is attached to the upper portions 3 of the vertical frame members 2 to provide comfort when a person presses fronts or backs of his or her shoulders against the upper portions 3 of the vertical frame members 2 while exercising. Due to the flexibility of the upper portions 3 of the vertical frame members 2, persons can easily reposition themselves by simply turning their bodies 180 degrees and repositioning the upper portions 3 of the vertical frame members 2.

Figure 2:
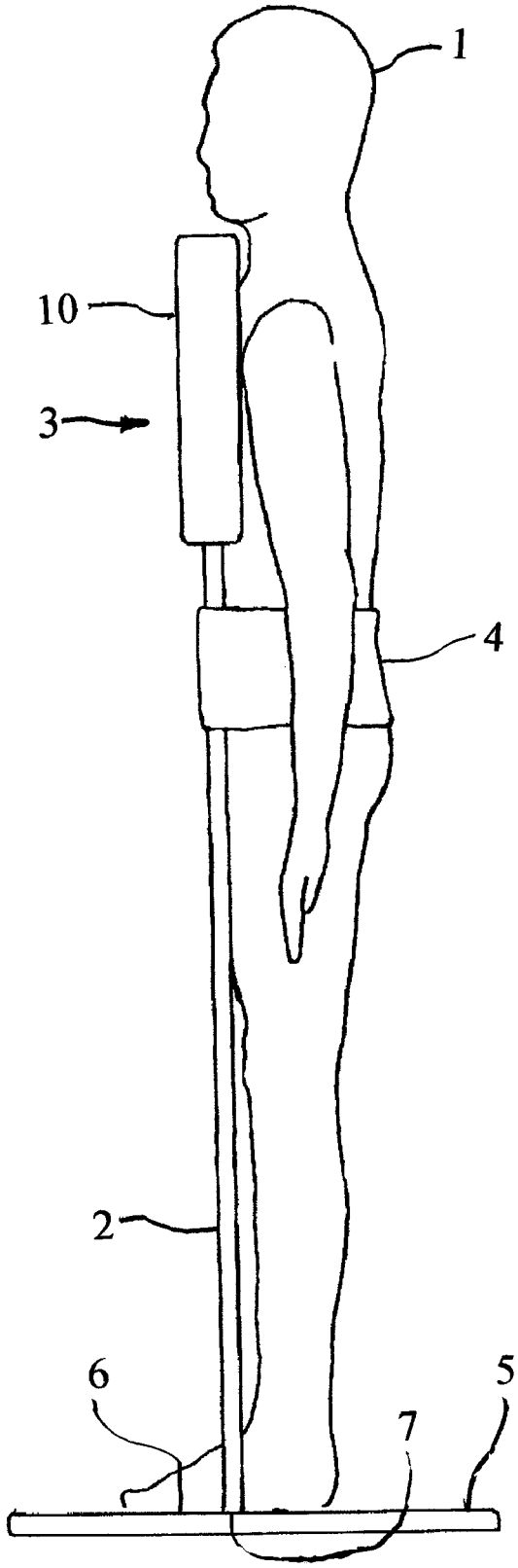
FIG. 2 is a side view of the apparatus of claim 1, additionally showing a person standing on a base of the apparatus in preparation of exercising his or her abdominal muscles.
Figure 3:
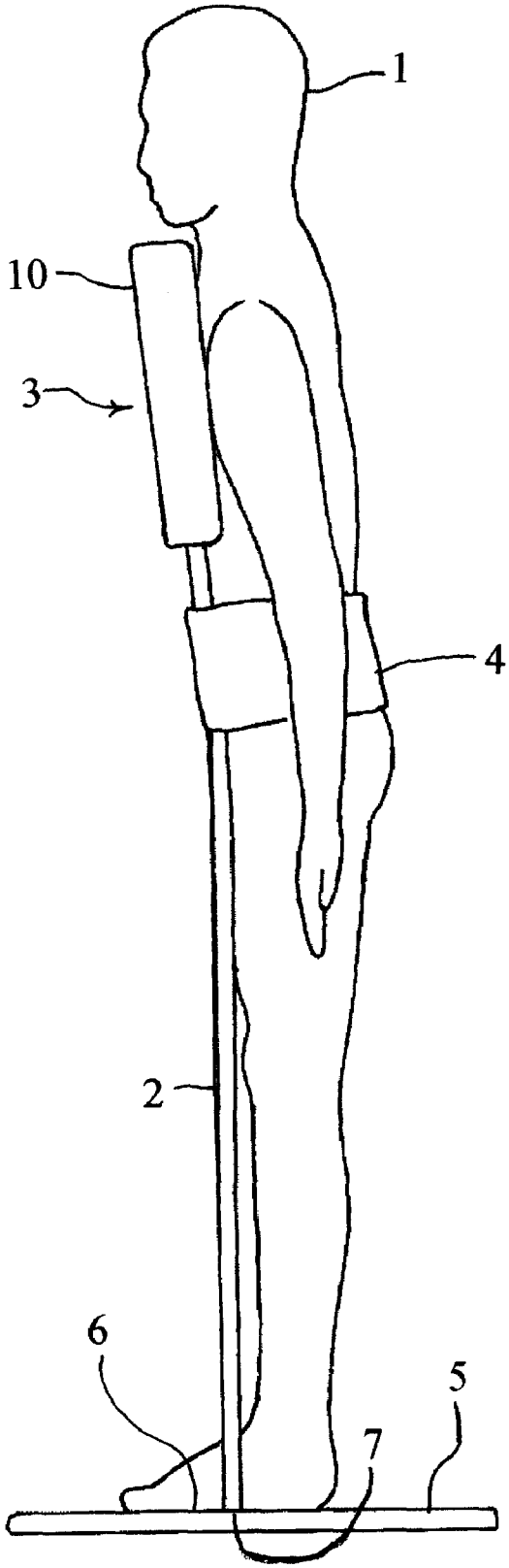
FIG. 3 is a side view, similar to that of FIG. 2, of the person exercising his or her abdominal muscles.

FIG. 2 shows a person 1 standing on the apparatus base 5, at a position indicated by the reference numeral 6, in preparation of exercising his or her abdominal muscles, with the front of his or her shoulders pressed against the padding 10 on the upper portions 3 of the vertical frame members 2 and the middle support 4 adjusted about his or her waist. FIGURE 3 shows a person 1 standing on the apparatus base 5, with the fronts of his or her shoulders pressed against the padding 10 on the upper portions 3 of the vertical frame members 2, and exercising his or her abdominal muscles by bending forward against the resistance of the upper portions 3 of the vertical frame members 2. While bending forward, the middle support 4 prevents rearward movement of his or her waist.

Figure 4:
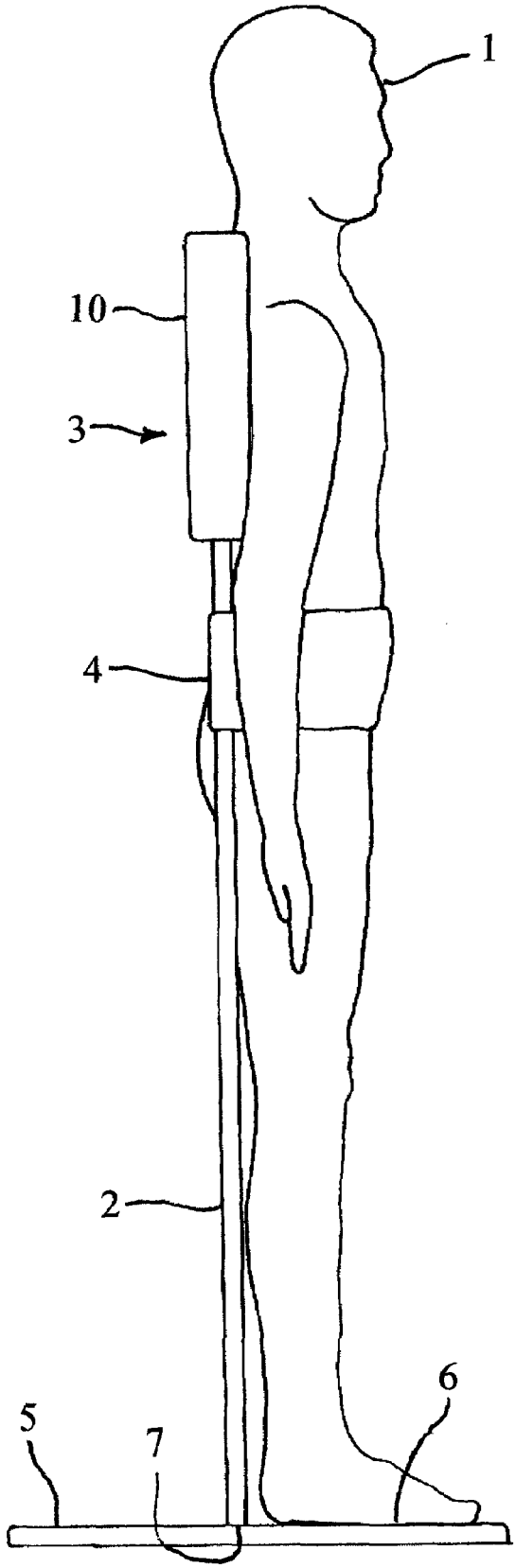
FIG. 4 is a side view of the apparatus of FIG. 1, additionally showing a person standing on a base of the apparatus in preparation of exercising his or her back muscles.
Figure 5:
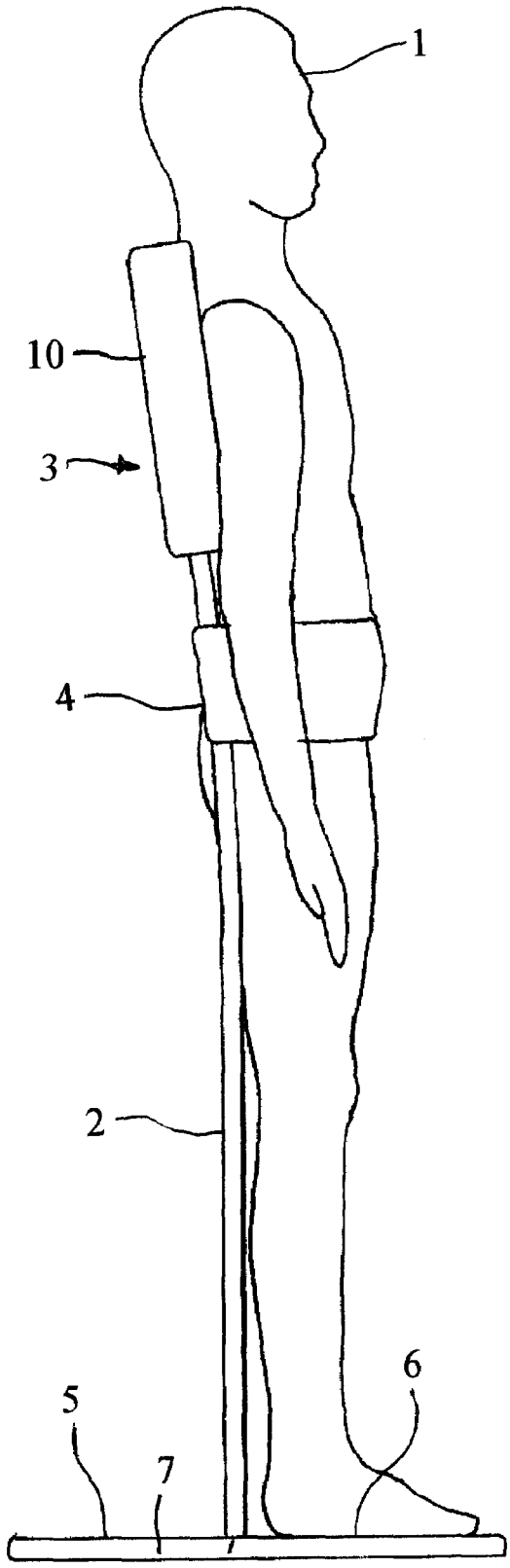
FIG. 5 is a side view, similar to that of FIG. 2, of the person exercising his or her back muscles.

FIG. 4 shows a person 1 standing on the apparatus base 5, at a position indicated by the reference numeral 6, in preparation of exercising his or her back muscles, with the backs of his or her shoulders pressed against the padding 10 on the upper portions 3 of the vertical frame members 2 and the middle support 4 adjusted about his or her waist. FIG. 5 shows a person 1 standing on the apparatus base 5, with the backs of his or her shoulders pressed against the padding 10 on the upper portions 3 of the vertical frame members 2, and exercising his or her back muscles by bending backward against the resistance of the upper portions 3 of the vertical frame members 2. While bending backward, the middle support 4 prevents forward movement of his or her waist.

The solution to the problem described in the foregoing Background Art section is the apparatus for exercising deep abdominal and back muscles in a standing position presented here, which apparatus has an adjustable middle support, characterized in that the apparatus consists of a minimum of two at least partially flexible frames, whose other ends are anchored onto a base, onto their own base, or onto the floor, or onto the ceiling above the frame or, with attachments, onto the upper frame of a door in an upright position so that the frames are at a distance from each other for a person to fit though and the other frame ends are not attached to one other.

This solution generates many benefits. There is no longer a need for a complex adjustable upper support. In the solution, the frames act both as a resistance and as a support. This is possible, because the frames do not pass the operator's face from a close distance; instead, passing the head on the sides, they go pass along the shoulders, which are able to carry weight. Consequently, the operator can stand on the same line with the apparatus and no problematic distance is created between the operator and the frame. For this reason, the middle support can also be attached onto the frame on the same line. The middle support can be any rather wide belt-type element, which can be adjusted up and down the frame. A belt adjustable with Velcro tape is a recommendable solution. The adjustment up and down the frame can be solved so that the belt stays in place with fraction pressure between frame and a strip-like piece attached to the frame. And, the strip or any other piece is attached to the frame through friction and, consequently, easy to adjust manually up and down the frame.

As the other frame ends are free, the side adjustment of the frames or upper supports is done by simply bringing closer or farther away the flexible frame ends with an easy handgrip. The frames can be made to pass exactly in the operator's shoulder areas. As the upright frames act as the upper supports, there is no need for an up/down adjustment. Regardless of the operator's size, the frames are always located in the right place on him/her. In the event the operator's measurements are extreme as regards the height, it may be necessary to know how to adjust the padding 3 up or down the frame. This is easy to do, if the frame is a round tube and the padding 3 is a tube-shaped padding 3 cover pushed onto the tube. The only part in the apparatus to be tangibly adjusted in line with the operator's measurements is the middle support, which the operator uses as a support for the abdomen or back. As already mentioned above, this support may be a rather wide belt or other piece stretched between the frames. The main concern is for it to be strong enough for a person to twist The best solution for the lower support is a plate-type base, which keeps the frames in an upright position. The frames are attached to the plate at a distance from each other for a person to be able to stand on the plate between the frames. The operator's weight is enough to keep the frames in place during exercising. Of course, it is possible to attach the frames onto the floor with fasteners, but this solution does not allow the apparatus to be moved anywhere else. Also, the frames could possible be fastened to the operator's ankles or feet, but this is not advisable, because, in the event the person doing the exercises loses his/her balance, the feet must not be attached to the lower support; it has to be possible to move them freely. This is why, in the solution with free movement, an apparatus standing on its own base and staying in place because of the weight of the operator is optimal. The person does the exercises in the apparatus so that the middle support is adjusted to be a little loose. Thereafter, to exercise the back muscles, the person, facing the apparatus, steps into the apparatus until the middle support presses against the abdominal muscles. Then, he/she slips to the front of the upper supports, whereupon the supports or frames rest against the back of the shoulders. As the ends of the flexible frames are free, it is easy to place the upper supports or frames on the back side. Now the exercise session may begin. As the middle support and upper supports are on the opposite sides of the body, with the lower support staying in place, the flexible frames form a resistance or counterforce as the operator bends backward. To exercise the abdominal muscles, the operator, facing away from the apparatus, steps onto the base, i.e., the operator backs up until his/her middle support presses against the lumbar region. The upper body is now slipped through the upper frames so that the upper frames or supports lean against the front of the shoulders. Now the operator is in the right position to do abdominal muscle exercises. The supports are on the opposite sides of the body; hence, as the operator now bends forward, the frames generate a counterforce to the abdominal muscles.

The rigidity of the frames of the apparatus can be adjusted, e.g., employing the telescope method. In the event the basic frame is a hollow pipe, it is easy to fit additional pipes inside the basic frame to increase rigidity. Another method is to equip the flexible frames with an inflexible, up/down-adjustable casing. The more the casing covers the flexible frames, the more rigid the frames become. With the above means, an apparatus was created, which apparatus has all the attributes required of an apparatus spontaneously accepted by a busy person for performing daily back exercises.

The explanation and the drawings related thereto are only intended for illustrating the idea according to the invention. The details in the apparatus for exercising deep abdominal and back muscles according to the invention may vary within the framework of the claims.

The invention claimed is:

1. An apparatus for exercising deep abdominal and back muscles of a person while in a standing position, the apparatus comprising:

a base having a lower side adapted to freely and independently rest upon a floor surface and an upper side sized for the person to stand on;

at least a first and a second elongate vertical frame members having first and second ends, each vertical frame member anchored to the base at its first end to vertically position the frame members and each vertical frame member being free its second end, each vertical frame member having at least a flexible upper portion for cooperation with the shoulder region of the person, the vertical frame members being spaced apart and initially extending parallelly upwardly from the base and free to be flexed in lateral, forward and rearward directions relative to the person standing on the base with the person's chest or back positioned against both of the vertical frame members; and a vertically adjustable middle support extending transversely between, and proximately connected to midpoints of, the vertical frame members for engaging the lower torso of the person;

wherein the person may exercise one of the deep abdominal and back muscle groups by standing on the base with the middle support engaging one side of the person's lower torso and with the first and second vertical frame member upper portions engaging the shoulder region of the opposite side of the person's torso, so that as the person bends toward the vertical frame member upper portions, the middle support exerts a counter-force on the person to exercise the oppositely located muscle group as the frame members flex.

2. The exercise apparatus according to claim 1, further comprising padding affixed proximate the upper end of each vertical frame member.

* * * * *

UNITED STATES PATENT AND TRADEMARK OFFICE

CERTIFICATE OF CORRECTION

PATENT NO. : 7,585,261 B2
APPLICATION NO. : 11/569831
DATED : September 8, 2009
INVENTOR(S) : Jarl Fredrik Serlachius It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 88 days.

Signed and Sealed this

Fourteenth Day of September, 2010

David J. Kappos

David J. Kappos
*Director of the United States Patent and Trademark Office*